US011814913B2

(12) United States Patent
Ghanmi et al.

(10) Patent No.: US 11,814,913 B2
(45) Date of Patent: Nov. 14, 2023

(54) SYSTEM AND METHOD FOR USE OF A SELF-AUTOMATED ADJUSTED CHOKE VALVE

(71) Applicant: SAUDI ARABIAN OIL COMPANY, Dhahran (SA)

(72) Inventors: Ahmed A. Ghanmi, Hofuf (SA); Fahmi Aulia, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 54 days.

(21) Appl. No.: 17/451,757

(22) Filed: Oct. 21, 2021

(65) Prior Publication Data

US 2023/0126989 A1 Apr. 27, 2023

(51) Int. Cl.

| | |
|---|---|
| ***E21B 47/06*** | (2012.01) |
| ***E21B 34/08*** | (2006.01) |
| ***E21B 34/16*** | (2006.01) |
| ***E21B 21/08*** | (2006.01) |
| ***E21B 34/02*** | (2006.01) |

(52) U.S. Cl.

CPC ..... *E21B 21/08* (2013.01); *E21B 34/025* (2020.05); *E21B 34/08* (2013.01); *E21B 34/16* (2013.01); *E21B 47/06* (2013.01); *E21B 2200/20* (2020.05)

(58) Field of Classification Search

CPC ..... E21B 34/025; E21B 34/02; E21B 34/04; E21B 34/045; E21B 34/08; E21B 34/16; E21B 47/06; E21B 2200/20; E21B 33/00

See application file for complete search history.

(56) References Cited

U.S. PATENT DOCUMENTS

| | | | | |
|---|---|---|---|---|
| 9,650,869 | B2 * | 5/2017 | Wilson | E21B 34/08 |
| 9,926,761 | B2 * | 3/2018 | Massa De Campos | G05B 11/36 |
| 10,221,645 | B2 * | 3/2019 | Elliott | E21B 43/013 |

(Continued)

OTHER PUBLICATIONS

Moustafa et al.; "Implementing a Production Performance Management Platform for Better Production Data Management, Improved Surveillance and Forecasting for Mature Fields—A Case Study in Sharjah, UAE", SPE-203291-MS; Society of Petroleum Engineers; Nov. 9, 2020; pp. 1-10 (10 pages).

(Continued)

*Primary Examiner* — Catherine Loikith

(74) *Attorney, Agent, or Firm* — Osha Bergman Watanabe & Burton LLP

(57) ABSTRACT

A choke valve is coupled to a Christmas tree on a wellhead. A smart module is coupled to the choke valve. A hydraulic control is coupled to the smart module and the choke valve. The hydraulic control unit hydraulically actuates the choke valve. A first sensor is attached upstream of the choke valve and a second sensor is attached downstream of the choke valve. The first sensor measures an upstream pressure and the second sensor measures a downstream pressure. A controller is coupled to the smart module and the hydraulic control unit. The smart module receives the upstream pressure, the downstream pressure, and well data to generate commands to adjust a choke size of the choke valve corresponding with a required production rate of a well. The controller manages a transmission of hydraulic pressure from the hydraulic control unit to actuate the choke valve based on the generated commands.

19 Claims, 8 Drawing Sheets

(56) References Cited

U.S. PATENT DOCUMENTS

| | | | | |
|---|---|---|---|---|
| 2016/0102511 | A1 | 4/2016 | Brana et al. | |
| 2018/0347312 | A1* | 12/2018 | Green | E21B 47/06 |
| 2020/0325742 | A1 | 10/2020 | Astudillo et al. | |

OTHER PUBLICATIONS

Karantinos et al.; "A General Method for the Selection of an Optimum Choke-Management Strategy", SPE 174196; SPE Production & Operations; vol. 32; Issue 2; May 2017; pp. 137-147 (11 pages).

Chris Carpenter; "Model Helps Guide Choke-Management Strategies Under Constraints"; JPT Technology; Sep. 2018; pp. 91-93 (3 pages).

Hong et al.; "Modified Choke Models to Predict Natural Gas Well Flow Rate", ISOPE-I-18-413; The 28th International Ocean and Polar Engineering Conference; Jun. 10, 2018; pp. 24-30 (7 pages).

W. Palen and A Goodwin; "Increasing Production in a Mature Basin: 'The Choke Model'", SPE 36848; Society of Petroleum Engineers; Oct. 22, 1996; pp. 299-307 (9 pages).

* cited by examiner

SYSTEM AND METHOD FOR USE OF A SELF-AUTOMATED ADJUSTED CHOKE VALVE

BACKGROUND

Fluids produced from a hydrocarbon reservoir may include natural gas, oil, and water. In the oil and gas industry, as illustrated in FIG. 1, the fluids are produced from a reservoir 1 in a formation 2 by drilling a wellbore 3 into the formation 2, establishing a flow path between the reservoir 1 and the wellbore 3, and conveying the fluids from the reservoir 1 to a surface 4 through the wellbore 3. A casing 5 may be installed in wellbore 3. In some embodiments, the casing 5 may be perforated to have perforations 6 into the reservoir 1 to allow a flow of the fluids to enter the wellbore 3. Typically, a production tubing 7 is disposed in the wellbore 3 to carry the fluids to the surface 4. The production tubing 7 hangs from a wellhead 8 at the surface 4. The production tubing 7 extends past the reservoir 1, thereby forming a flow conduit from the reservoir 1 to surface 4.

A tree (also known as a Christmas tree) 9 is disposed on top of the wellhead 8 to control a flow of fluids into or out of the wellbore 3, depending on whether it is an injection well or a production well. The Christmas tree 9 includes a configuration of valves to control the fluids being injected into or pumped out of the wellbore 3. For example, the Christmas tree 9 may have an injection wing valve 10, a swab valve 11, a production wing valve 12, an upper master valve 13, and a lower master valve 14. When an operator is ready to conduction well operations the valves 10-14 are either opened or closed to control the fluids being injected into or pumped out of the wellbore 3. During injection, the production wing valve 12 and the swab valve 11 are closed while the injection wing valve 10, the upper master valve 13, and the lower master valve 14 are open to allow for fluids to be injected through the Christmas tree 9 and into the wellbore 3. During production, the injection wing valve 10 and the swab valve 11 are closed while the production wing valve 12, the upper master valve 13, and the lower master valve 14 are open to control or isolate fluid flow through a choke valve 15. From the choke valve 15, the fluids are transports, via a production flow line 16, to a production storage, transport, or facility.

The choke valve 15 is a mechanical device to control flow rates and pressure drops of the produced fluids. For example, an operational function of the choke valve 15 is to produce the fluids from the wellbore 3 at the desired rates by the introduction of human intervention to manually control the drawdown pressure. A choke size of the choke valve 15 is changeable to allow for the operator to adjust the amount of pressure dropped across the choke valve 15 in order to maintain a downstream pressure in the production flow line 16 at the desirable value which will lead to achieving the desirable rate.

As the performance of fluid production from the wellbore 3 is not constant and delineation will happen over the course of time, frequent rate testing is conducted where the choke size of the choke valve 15 is re-evaluated and adjusted to meet the target rate of fluid production. Conventional methods need to test the wellbore 3 with the choke valve 15 on the original settings to capture the well performance and then adjust the choke size of the choke valve 15 either based on historical performance trend or best engineering judgment. Then, the wellbore 3 is further tested for flow rate testing and verifications. These activities involved several operators visits to site to collect pressures at the wellhead 8 and the Christmas tree 9 and change choke size to maintain fluid production as per the required production rate. The conventional methods are dependent on workers being present at the well to oversee and conduct time-consuming valve operations during production. For example, a team of workers may meet, plan, and agree on a valve sequence to then actuate the valves to maintain the fluid production. As a result, conventional methods are prone to human errors resulting in improper actuation of valves, loss of fluid production, and expensive damage and non-productive time (NPT).

SUMMARY OF DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system including a choke valve coupled to a Christmas tree on a wellhead. A smart module may be coupled to the choke valve. A hydraulic control unit may be coupled to the smart module and the choke valve. The hydraulic control unit hydraulically actuates the choke valve. A first sensor may be attached upstream of the choke valve and a second sensor may be attached downstream of the choke valve. The first sensor measures an upstream pressure and the second sensor measures a downstream pressure. A controller may be coupled to the smart module and the hydraulic control unit. The smart module receives the upstream pressure, the downstream pressure, and well data to generate commands to adjust a choke size of the choke valve corresponding with a required production rate of a well. The controller may manage a transmission of hydraulic pressure from the hydraulic control unit to actuate the choke valve based on the generated commands.

In another aspect, embodiments disclosed herein relate to a method. The method may include placing a well in a production mode to produce fluids from a reservoir; uploading a historical production performance data of the well to a smart module to create Inflow Performance Relationship and Vertical Lift Performance Relationship curves; correlating, with the smart module, an upstream pressure and a downstream pressure relative to a choke valve with production flow rates in the Inflow Performance Relationship and Vertical Lift Performance Relationship curves; determining, with the smart module, a choke size that corresponds to a required production rate of the well based systematically interpolating the upstream pressure and the downstream pressure to the Inflow Performance Relationship and Vertical Lift Performance Relationship curves; automatically adjusting, with a controller coupled to the smart module, the choke valve to a required choke size associated with the required production rate in real-time, the automatically adjusting includes generating commands, with the smart module, for the controller to manage a transmission of hydraulic pressure from a hydraulic control unit to actuate the choke valve; and maintaining a required downstream pressure corresponding to the required production rate by the smart module generating the commands from the controller to adjust a choke size of the choke valve to match the required choke size.

In yet another aspect, embodiments disclosed herein relate to a non-transitory computer readable medium storing instructions on a memory coupled to a processor. The instructions may include functionality for: obtaining a historical production performance data of a well to create Inflow Performance Relationship and Vertical Lift Performance Relationship curves for the well; determining a choke size of a choke valve that corresponds to a required production rate of the well based systematically interpolating an upstream pressure and a downstream pressure to the Inflow Performance Relationship and Vertical Lift Performance Relationship curves, the upstream pressure is a fluid pressure upstream the choke valve and the downstream pressure is a fluid pressure downstream the choke valve; automatically adjusting, over a smart module coupled to the choke valve, the choke size to match a required choke size associated with the required production rate in real-time; transmitting, based on commands generated from the smart module, hydraulic pressure from a hydraulic control unit to actuate the choke valve; and maintaining a required downstream pressure corresponding to the required production rate by adjusting the choke size based on a measured downstream pressure.

Other aspects and advantages of the invention will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, shapes of the elements as drawn are not necessarily intended to convey any information regarding the actual shape of the elements and have been solely selected for ease of recognition in the drawing

DETAILED DESCRIPTION

Figure 1:
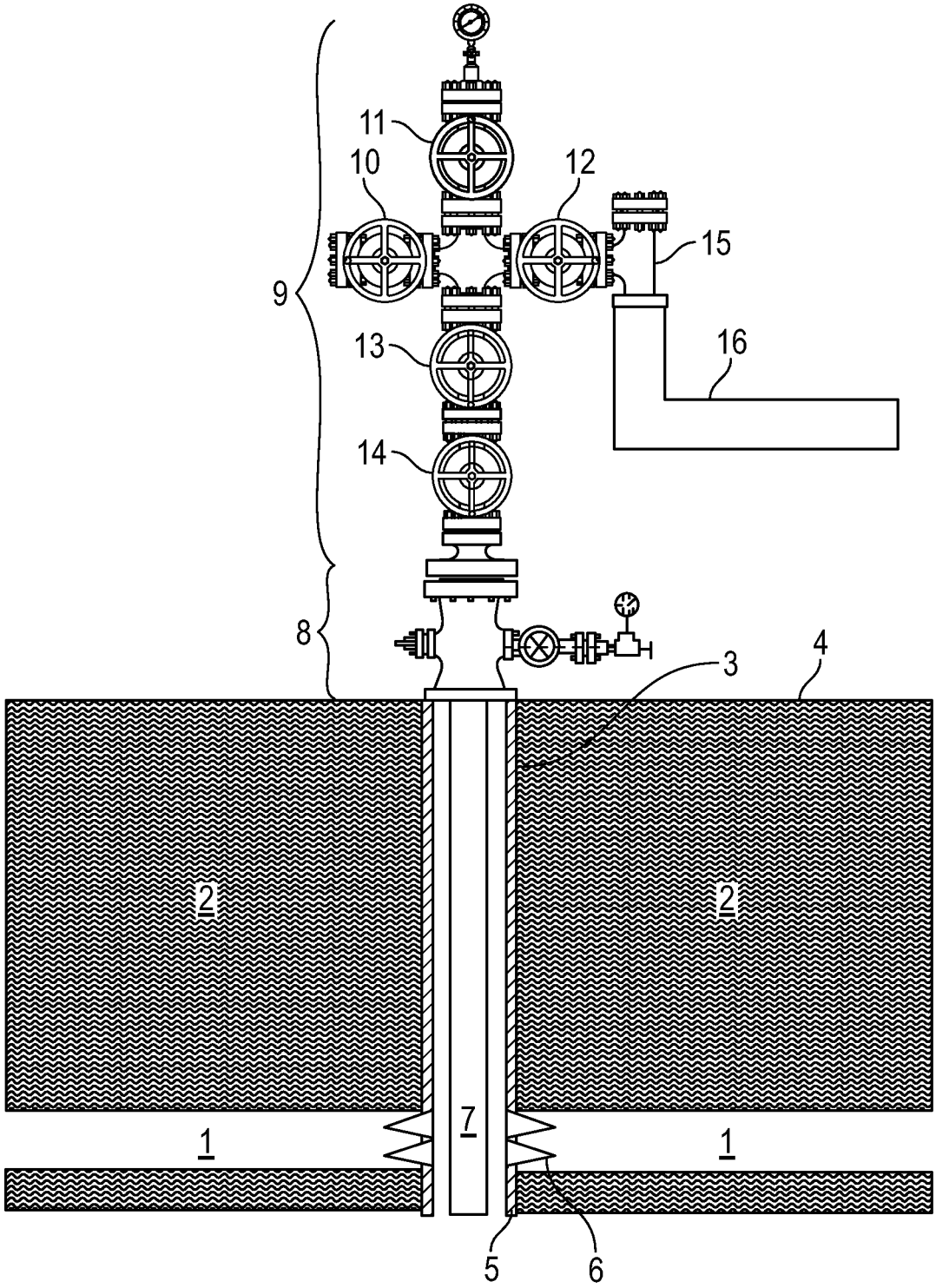
FIG. 1 (Prior Art)
FIG. 1 illustrates a schematic diagram of a completion well system in accordance with prior art.

Embodiments of the present disclosure are described below in detail with reference to the accompanying figures. However, one skilled in the relevant art will recognize that implementations and embodiments may be practiced without one or more of these specific details, or with other methods, components, materials, and so forth. For the sake of continuity, and in the interest of conciseness, same or similar reference characters may be used for same or similar objects in multiple figures. As used herein, the term "coupled" or "coupled to" or "connected" or "connected to" "attached" or "attached to" may indicate establishing either a direct or indirect connection, and is not limited to either unless expressly referenced as such.

Further, embodiments disclosed herein are described with terms designating a rig site in reference to a land rig, but any terms designating rig type should not be deemed to limit the scope of the disclosure. For example, embodiments of the disclosure may be used on an offshore rig and various rig sites, such as land/drilling rig and drilling vessel. It is to be further understood that the various embodiments described herein may be used in various stages of a well, such as rig site preparation, drilling, completion, abandonment etc., and in other environments, such as work-over rigs, fracking installation, well-testing installation, and oil and gas production installation, without departing from the scope of the present disclosure. The embodiments are described merely as examples of useful applications, which are not limited to any specific details of the embodiments herein.

In one or more embodiments, the present disclosure may be directed to systems and methods for a self-automated adjustable choke valve to autonomously maintain a downstream pressure removing a fluctuating well performance impact on a well production. More specifically, embodiments disclosed herein are directed to an autonomous production system for operating a self-automated adjustable choke valve to maintain a fluid production of a well at a predetermined production rate. In particular, this autonomous production system is orchestrated by a controller of a smart module. For example, the smart module may be in communication with a controller such that the controller may manage a transmission of hydraulic power from a hydraulic control unit to the self-automated adjustable choke valve based on upstream and downstream pressures. The smart module further generates commands for the controller to utilize hydraulic pressure to actuate the self-automated adjustable choke valve. Accordingly, the smart module maintains a predetermined downstream pressure along with a required hydraulic pressure in order to autonomously actuate a size of the self-automated adjustable choke valve to meet the predetermined production rate. Overall, the self-automated adjustable choke valve with the autonomous production system as described herein may reduce product engineering, reduction of assembly time, hardware cost reduction, and weight and envelope reduction. The one or more embodiments of a method of using the self-automated adjustable choke valve with the autonomous production system results in achieving well production targets without the need for operators to frequently visit and testing the well and reduction in operational costs associated with conventional production operations.

Figure 2:
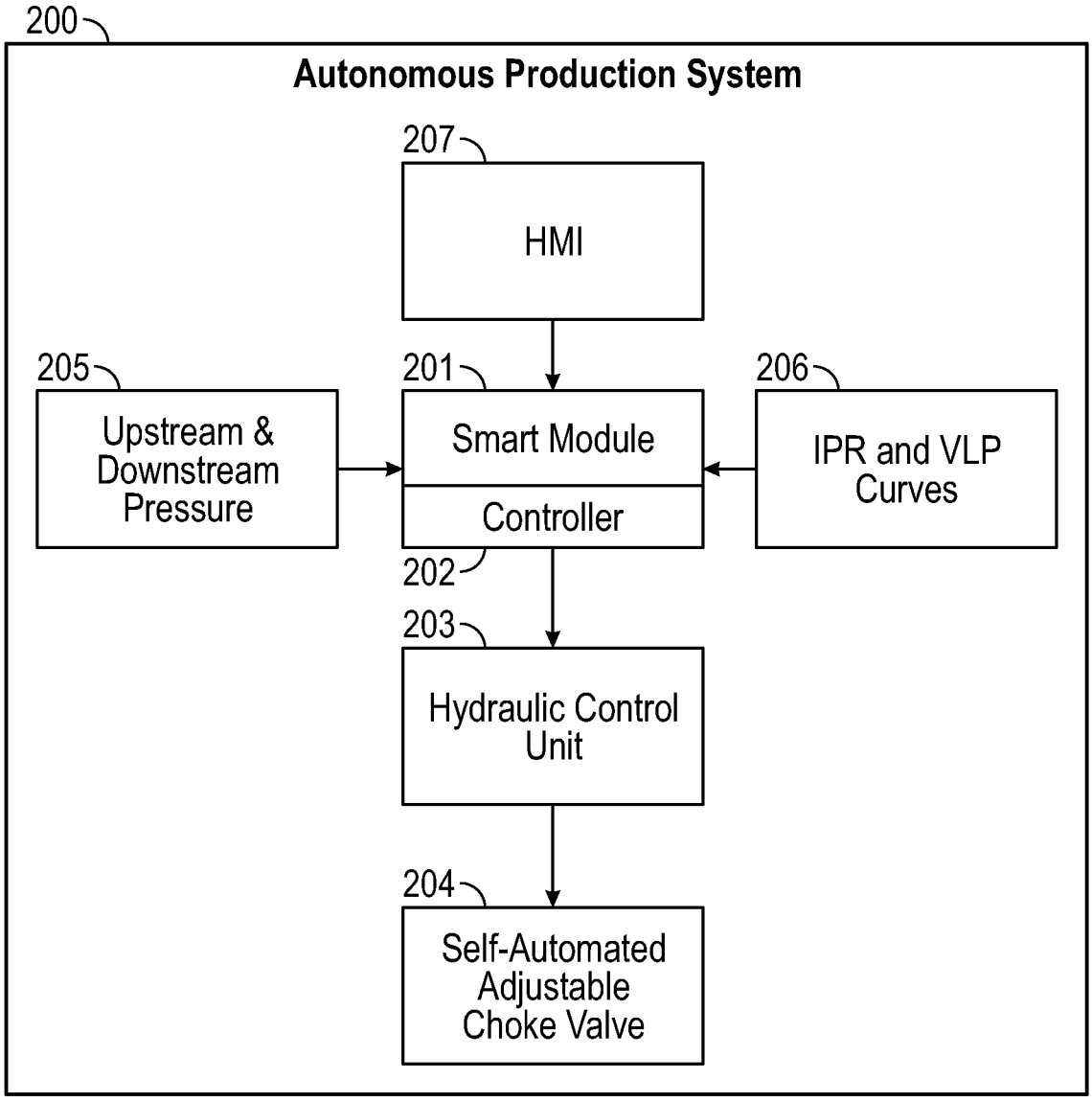
FIG. 2 illustrates a block diagram of an autonomous production work process according to one or more embodiments of the present disclosure.

Turning to FIG. 2, FIG. 2 shows a block diagram of an autonomous production system 200 in accordance with one or more embodiments. The autonomous production system 200 is operatively connected to at least one wellhead assembly (e.g., a Christmas tree) on a surface at a well site. The autonomous production system 200 includes a smart module 201 having a controller 202 coupled to a hydraulic control unit 203 powering a self-automated adjustable choke valve 204 at the well site. In some embodiments, the smart module 201 and the controller 202 may be integrated within the hydraulic control unit 203. The controller 202 controller may manage a transmission of hydraulic pressure from the hydraulic control unit 203 to actuate the self-automated adjustable choke valve 204 based on commands from the smart module 201. The self-automated adjustable choke valve 204 is coupled to the Christmas tree. Additionally, the Christmas tree may include one or more valves fluidly connected to a wellhead that are adapted to control the flow of fluid into and out of the wellhead. Valves associated with a Christmas tree include, but are not limited to, upper and lower master valves, wing valves, and swab valves, each named according to a respective functionality on the wellhead assembly.

In one or more embodiments, sensors on the Christmas tree and the production flow line provide an upstream and downstream pressure 205, relative to the self-automated adjustable choke valve 204, to the smart module 201. For example, the Christmas tree is upstream of the self-automated adjustable choke valve 204 and the production flow line is downstream of the self-automated adjustable choke valve 204. Additionally, Inflow Performance Relationship (IPR) and Vertical Lift Performance Relationship (VLP) curves 206 are uploaded to the smart module 201. For example, the smart module 201 may include software to create the IPR and VLP curves 206 based on historical production performance data of the corresponding well. It is further envisioned that other declining well performance curves and wellhead parameters are also uploaded to the smart module 201. The IPR curve plots a flow rate (i.e., fluid flowing out of the reservoir of the well) versus a bottomhole pressure (i.e., pressure at a bottom of the well approximate the reservoir). For example, IPR curve may represent the volume of fluids the reservoir can deliver to the bottom hole. The VLP curve plots the production rate (i.e., fluid flowing out up the well to the wellhead) versus the bottom hole pressure at a given a wellhead pressure. For example, the VLP curve may represent what the volume of fluids the well can deliver to the surface to show how much pressure required to lift the volume of fluid to the surface at the given wellhead pressure.

In some embodiments, the smart module 201 records, in real-time, the upstream and downstream pressure 205 and systematically interpolates the upstream and downstream pressure 205 to the IPR and VLP curves 206 and other parameters (e.g., sensitivities of choke sizes) transmitted in the smart module 201. Based on the upstream and downstream pressure 205 and the IPR and VLP curves 206, the smart module 201 generates commands for the controller 202 to operate the self-automated adjustable choke valve 204 utilizing the hydraulic control unit 203 to actuate the self-automated adjustable choke valve 204 to a required choke size associated with targeted flow rates. For example, in the event a flowing wellhead pressure drops due to declining of well performance and causes the downstream pressure to decrease below a desirable downstream pressure, the smart module 201 is configured to automatically command the controller 202 to operate the hydraulic control unit 203; the hydraulic control unit 203 then applies a hydraulic pressure to actuate the self-automated adjustable choke valve 204 to the required choke size until a required downstream pressure is achieved so the required production rate can be maintained. In some embodiments, the self-automated adjustable choke valve 204 may have an adjustable choke size ranging from 0" to 172/64".

Still referring to FIG. 2, the controller 202 may be hardware and/or software that includes functionality to manage a hydraulic pressure from the hydraulic control unit 203 to actuate the self-automated adjustable choke valve 204. For example, the smart module 201 informs the controller 202 to actuate the self-automated adjustable choke valve 204. Specifically, the controller 202 may control the use and transmission of hydraulic power from the hydraulic control unit 203 to actuate the self-automated adjustable choke valve 204 such that a piston of the self-automated adjustable choke valve 204 may move up and down to a desired position. Likewise, the controller 202 may also control warning alarms and/or pressure releases within the hydraulic control unit 203 and the self-automated adjustable choke valve 204. It is further envisioned that the controller 202 may be a ruggedized computer system with functionality to withstand vibrations, extreme temperatures, wet conditions, and/or dusty conditions, for example, around a well.

Moreover, the controller 202 may be coupled to various control systems that include multiple PLCs within the hydraulic control unit 203 and the self-automated adjustable choke valve 204. For example, a control system may include functionality to control operations within a system, assembly, and/or subassembly described below in FIG. 3 and the accompanying description. As such, the autonomous production system 200 may include functionality to monitor and/or perform various production processes performed by various operations with respect to the fluids being produced from the well. Without loss of generality, the term "control system" may refer to a production operation control system that is used to operate and control the equipment, a production data acquisition and monitoring system that is used to acquire production process and equipment data and to monitor the operation of the production process, or a production interpretation software system that is used to analyze and understand production events and progress.

In one or more embodiments, a human-machine interface (HMI) 207 may be hardware and/or software coupled to the smart module 201. For example, the HMI 207 may allow the operator to interact with the self-automated adjustable choke valve 204, e.g., to send commands to the controller 202 for hydraulic actuation from the hydraulic control unit 203, or to view sensor information (e.g., the upstream and downstream pressure 205 and the IPR and VLP curves 206) from the well equipment (e.g., the Christmas tree, the self-automated adjustable choke valve 204, the hydraulic control unit 203, and the production flow line). Further, the HMI 207 may include functionality for presenting data and/or receiving inputs from a user regarding various production operations. In a non-limiting example, the HMI 207 may be a user device such as a personal computer, a smartphone, a tablet, a smart wearable device, or any other device coupled to a network that obtain inputs from one or more users, e.g., by providing a graphical user interface (GUI) for presenting data and/or receiving control commands for operating the well equipment (e.g., the Christmas tree, the self-automated adjustable choke valve 204, the hydraulic control unit 203, and the production flow line).

In some embodiments, the well equipment (e.g., the Christmas tree, the self-automated adjustable choke valve 204, the hydraulic control unit 203, and the production flow line) transmitting data may be a network element coupled to the HMI 207. The network element may refer to various hardware components within a network, including switches, routers, hubs or any other logical entities for uniting one or more physical devices on the network. In particular, a network element, the HMI 207, and/or the smart module 201 may be a computing system similar to the computing system 600 described in FIG. 6, and the accompanying description.

Figure 3:
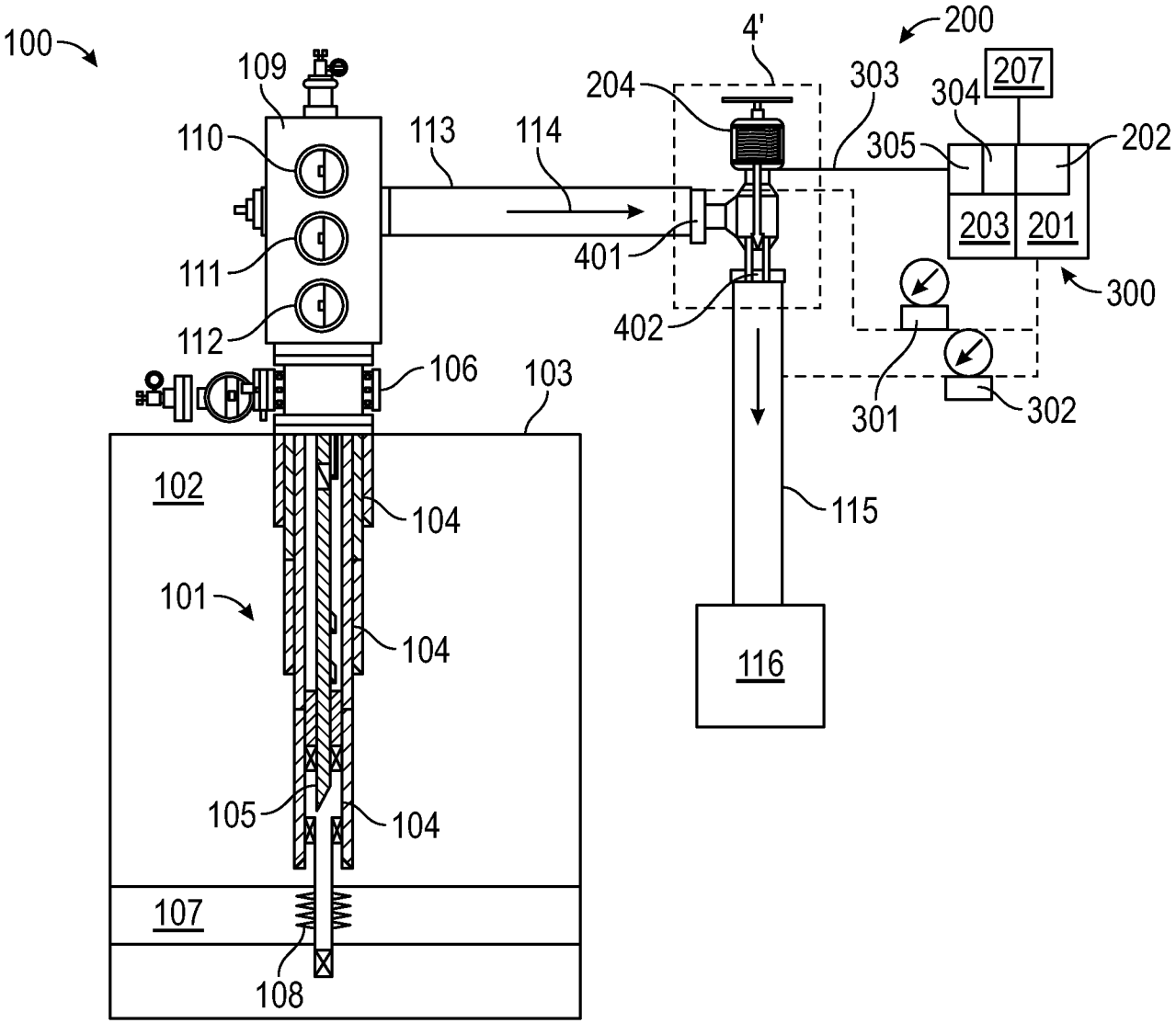
FIG. 3 illustrates a schematic diagram of a completion well system using the work process of FIG. 2 according to one or more embodiments of the present disclosure.

Turning to FIG. 3, in one or more embodiments, FIG. 3 shows an example of production operation over the smart module 201 of FIG. 2 at a well site 100. The well site 100 includes a well 101 extending into a formation 102 below a surface 103. For example, the well 101 may be a completion well having a plurality of casing strings 104 cemented within the well 101. A production string 105 is lowered into the well 101 to hang from a wellhead 106 at the surface 103. The production string 105 creates a conduit for fluids (e.g., hydrocarbons) produced in a reservoir 107 to flow through perforations 108 and up to the surface 103. Additionally, a Christmas tree 109 is disposed on top of the wellhead 106 to control a flow of the fluids out of the well 101. For example, the Christmas tree 109 includes a configuration of valves, such as a swab valve 110, an upper master valve 111, and a lower master valve 112. to direct the flow of the fluids within the Christmas tree 109.

In one or more embodiments, a production outlet 113 is coupled to the Christmas tree 109 between the swab valve 110 and the upper master valve 111. The production outlet 113 allows fluids produced from the reservoir 107 to exit the Christmas tree 109. For example, the swab valve 110 is closed while the upper master valve 111 and the lower master valve 112 are opened to direct the flow fluids through the Christmas tree 109 to the production outlet 113.

Still referring to FIG. 3, in one or more embodiments, the self-automated adjustable choke valve 204 is fluidly coupled to the production outlet 113 at an end distal to the Christmas tree 109. For example, the fluids flowing (see arrow 114) in the production flow line 113 enter an inlet 401 of the self-automated adjustable choke valve 204. In the self-automated adjustable choke valve 204, the fluid flow may be restricted by a choke size that is adjusted via the smart module 201 before exiting an outlet 402 of the self-automated adjustable choke valve 204. At the outlet 402, a production flow line 115 is fluidly coupled to the self-automated adjustable choke valve 204 to transport the fluids to a production storage, transport, or facility 116. It is further envisioned that the self-automated adjustable choke valve 204 is the only choke valve between the production outlet 113 and the production flow line 115.

In some embodiments, one or more sensors (301, 302) are provided at the well site 100 to transmit data to the smart module 201. For example, a first sensor 301 is attached to the production outlet 113 to provide an upstream pressure, relative to the self-automated adjustable choke valve 204, to the smart module 201. A second sensor 302 is attached to the production flow line 115 to provide a downstream pressure, relative to the self-automated adjustable choke valve 204, to the smart module 201. The first sensor 301 and the second sensor 302 may be pressure sensors or any type of sensor capable of taking fluid pressure measurements. The first sensor 301 and the second sensor 302 may be disposed on the production outlet 113 and the production flow line 115 at the well site 100 and/or during the manufacturing of said flow lines. It is further envisioned that the first sensor 301 and the second sensor 302 may be provided inside said flow lines. In some embodiments, each the first sensor 301 and the second sensor 302 may have an antenna (not shown) to be in communication with the smart module 201 to transmit a real-time pressure measurement. Further, data acquisition hardware is incorporated into the first sensor 301 and the second sensor 302. By obtaining such information, the smart module 201 may form a closed loop control and monitoring system without visual inspection and reduce or eliminate human interaction with equipment at the well site 100.

As shown in FIG. 3, in one or more embodiments, the hydraulic control unit 203 as an integration unit 300 with the smart module 201 is provided at the well site 100. The hydraulic control unit 203 supplies hydraulic pressure to the self-automated adjustable choke valve 204 via a hydraulic line 303. The hydraulic control unit 203 also includes a motor 304 and a pump 305 which are controlled by the controller 202 of the smart module 201. For example, the smart module 201 may command the controller 202 to electrically activate the motor 304 to power to the pump 305 which hydraulically pressures up the self-automated adjustable choke valve 204 to a choke size corresponding to desired downstream pressure.

In one or more embodiments, the well 101 is placed in a production mode to produce the fluids from the reservoir 107. As the well 101 is in production mode, a historical production performance data on the well 101 is collected to create the IPR and VLP curves (see 206 in FIG. 2). Additionally, the IPR and VLP curves are plotted in relation to a flowing wellhead pressure vs production rate for each of designated choke sizes of the self-automated adjustable choke valve 204.

The smart module 201 is pre-loaded with the historical production performance data, the IPR and VLP curves with several sensitivities of choke sizes of the self-automated adjustable choke valve 204, and other supporting well data (historical choke performance, declining rate, etc.). Additionally, the first sensor 301 transmits inputs (e.g., the real-time upstream pressure measurement) to the smart module 201 and the smart module 201 correlates the input to with associated flow rates in the IPR and VLP curves and other inputted parameters. Further, the smart module 201 is configured to determine a required flow rate (e.g., the predetermined production rate) that corresponds to a required choke size based on the real-time upstream pressure measurement and the IPR and VLP curves. Subsequently, the smart module 201 is configured to automatically select the required choke size associated with a targeted flow rate in real-time. For example, the controller 202 of the smart module 201 may command the hydraulic control unit 203 to hydraulically actuate the self-automated adjustable choke valve 204 to have a choke size which flows the fluids out of the well at the required targeted flow rate. In one or more embodiments, to confirm that the required targeted flow rate is being achieved, the smart module 201 receives pressure measurements from the second sensor 302 to ensure that the downstream pressure matches the required targeted flow rate.

In some embodiments, the smart module 201 may be in communication with the HMI 207 using a software application and may be provided to aid in the automation of the self-automated adjustable choke valve 204. For example, the HMI 207, such as a computer, control panel, and/or other hardware components may allow an operator to interact through the HMI 207 with the smart module 201 in the autonomous production system 200. The HMI 207 may be at the well site 100 or in a remote location (i.e., office building) not at the well site 101. The HMI 207 may include a screen, such as a touch screen, used as an input (e.g., for a person to input commands) and output (e.g., for display) of a computing system. In some embodiments, the HMI 207 may also include switches, knobs, joysticks and/or other hardware components which may allow an operator to interact through the HMI 207 with the autonomous production system 200. Additionally, data may be presented through the HMI 207. The HMI 207 may include a graphical user interface (GUI) that displays information on a display device of the HMI 207. The GUI may include various GUI widgets that organize what data is shown as well as how data is presented to a user (e.g., data presented as actual data values through text, or rendered by the computing device into a visual representation of the data, such as through visualizing a data model). It is further envisioned that the autonomous production system 200 may locally collect, analyze, and transmit data to a cloud in real-time to provide information, such as equipment health, performance metrics, alerts, and general monitoring, to third parties remotely or through the HMI 207.

Figure 4A:
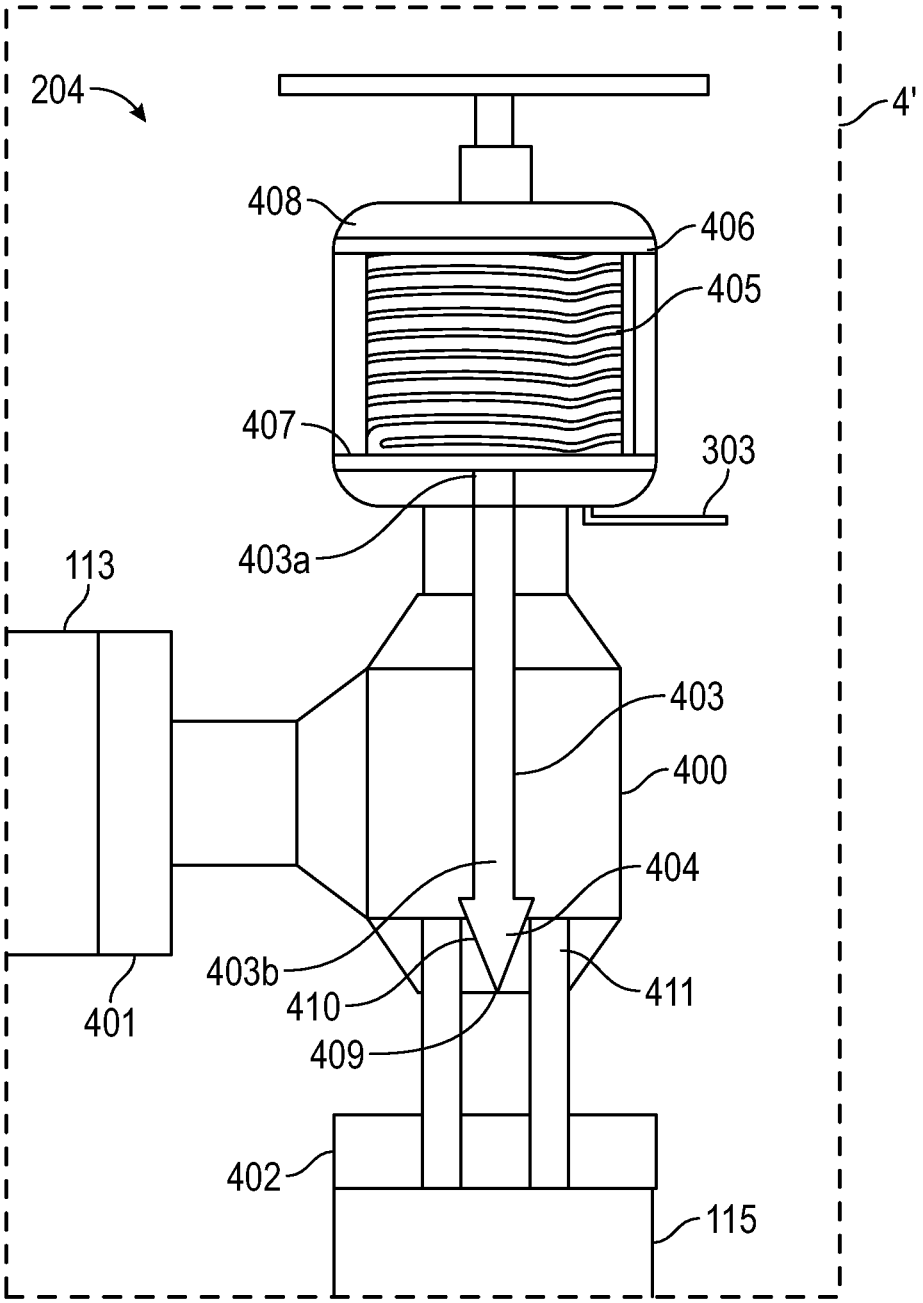
FIGS. 4A-4C illustrate a close-up diagram of the dotted box 4' from FIG. 3 according to one or more embodiments of the present disclosure.
Figure 4B:
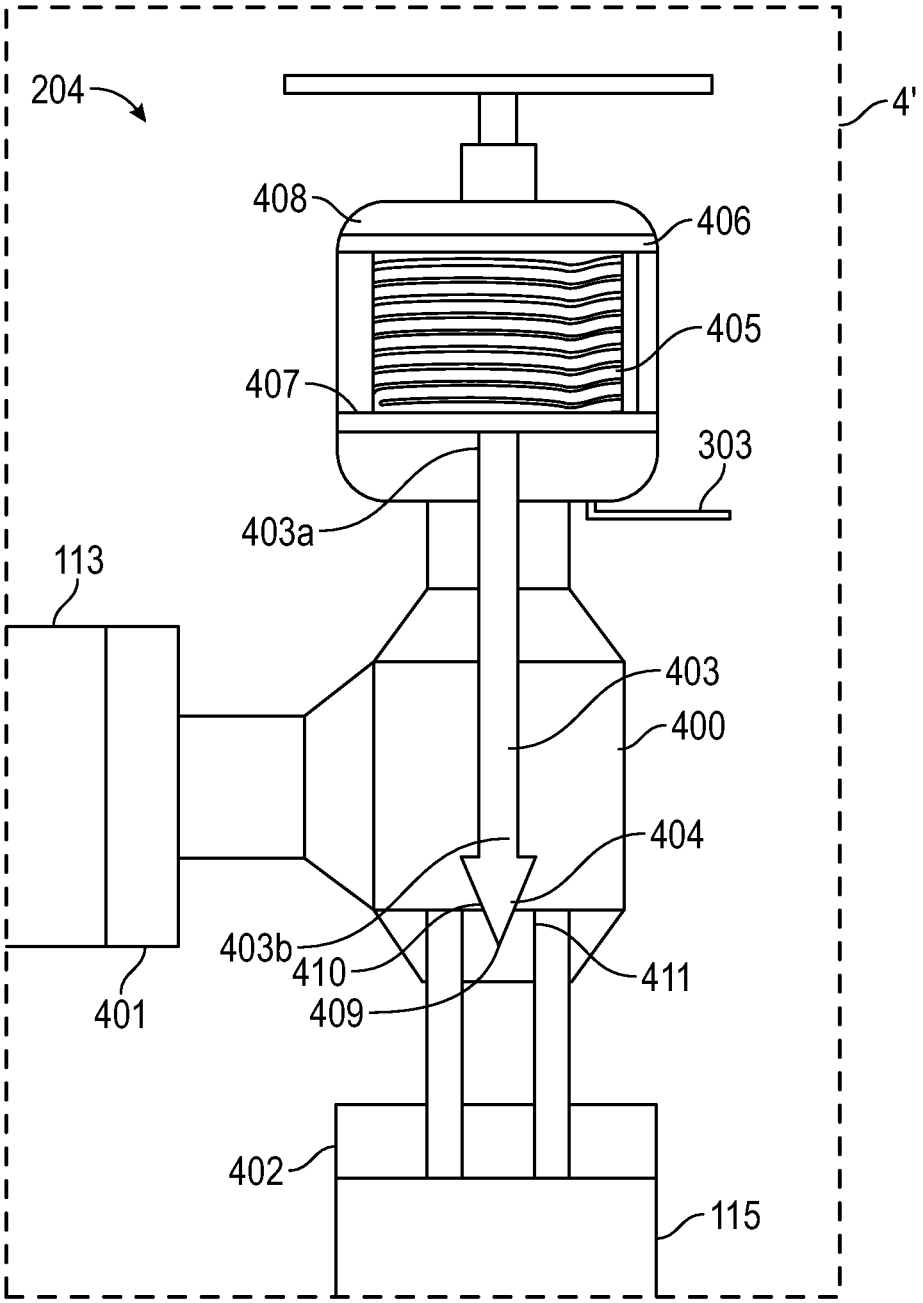
Figure 4C:
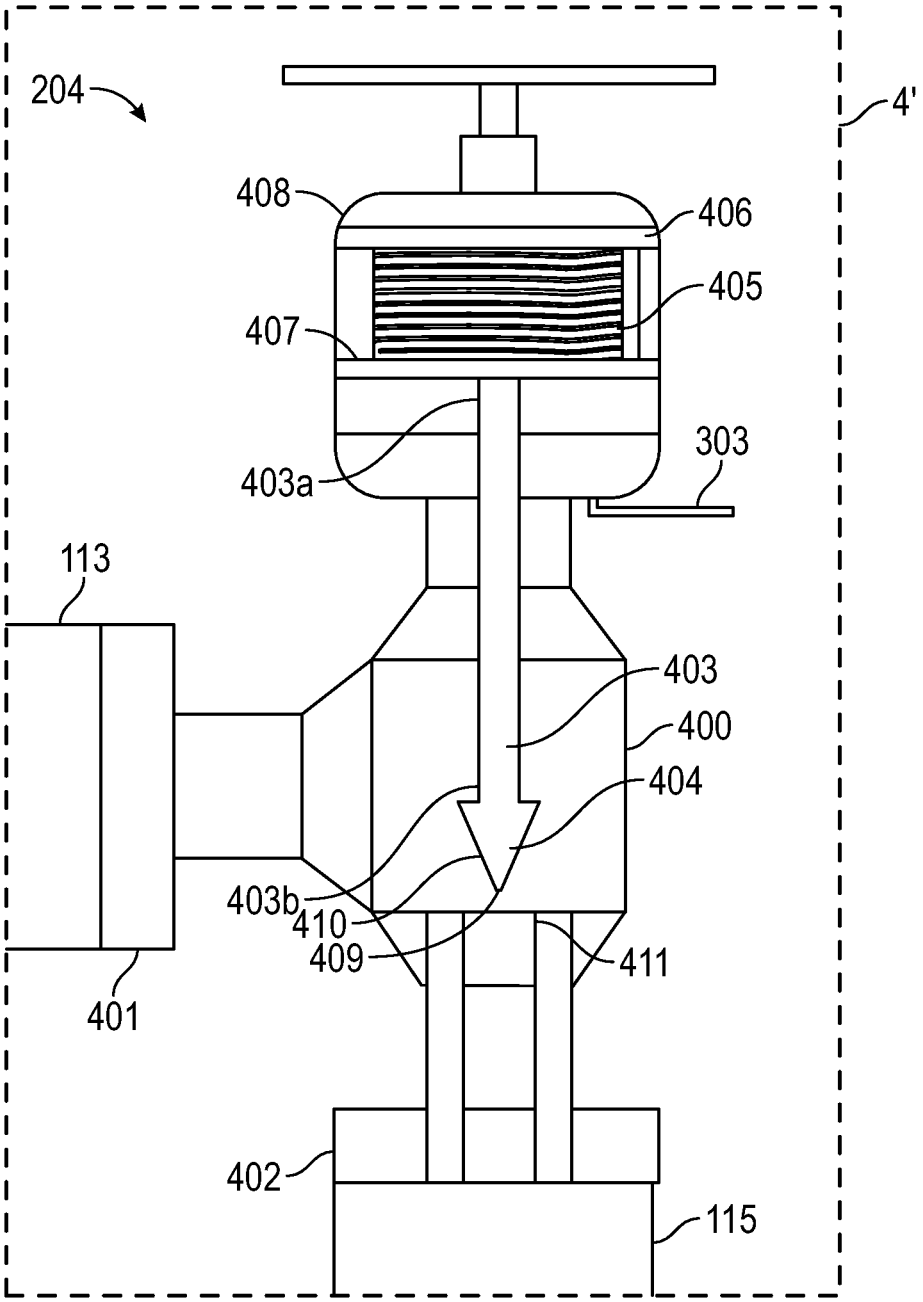

Now referring to FIGS. 4A-4C, the dotted box 4' in FIG. 3 illustrates a cross-sectional view of the self-automated adjustable choke valve 204 according to one or more embodiments. FIGS. 4A-4C show an expanded view of this dotted box 4' from FIG. 3. The self-automated adjustable choke valve 204 includes a flow bore 400 that fluidly connects the inlet 401 and the outlet 402. For example, the fluids exiting the production outlet 113 enters the inlet 401 to flow into the flow bore 400 and then flows into the production flow line 115 via the outlet 402.

In one or more embodiments, the self-automated adjustable choke valve 204 includes a piston 403, a tapered needle 404, and an actuation device 405 to restrict flow from the flow bore 400 to the outlet 402. The actuation device 405 may be a compressible spring attached to a top plate 406 and a bottom plate 407 within an actuation chamber 408. The hydraulic line 303 is attached to the actuation chamber 408 to provide a hydraulic pressure to move the bottom plate 407 thereby either compressing or decompressing the actuation device 405. The piston 403 extends from a first end 403*a* attached to the bottom plate 405 to a second end 403*b* distal to the actuation device 405.

In some embodiments, the tapered needle 404 is provided at the second end 403*b* of the piston 403. The tapered needle 404 extends from the second end 403*b* to a needle point 409. The tapered needle 404 also includes a tapered surface 410 having a non-zero slope. For example, the tapered surface 410 makes the tapered needle 404 have a variable diameter that gets progressively smaller from the second end 403*b* of the piston 403 to the needle point 409 thereby giving the self-automated adjustable choke valve 204 an adjustable choke size. For example, the adjustable choke size of the self-automated adjustable choke valve 204 may have a range of 0" to 172/64" with 0" being at the second end 403*b* of the piston 403 and 172/64" being at the needle point 409.

As shown in FIG. 4A, the self-automated adjustable choke valve 204 is in a first position. In the first position, the actuation device 405 is extended to have the piston 403 beaned down such that the tapered needle 404 is just above a seat 411 of the self-automated adjustable choke valve 204. With the needle 404 just above the seat 411, the tapered surface 410 forms the smallest choke size of the self-automated adjustable choke valve 204 to allow for fluid flow to the production flow line 115.

As shown in FIG. 4B, the self-automated adjustable choke valve 204 is illustrated in a second position. In the second position, the smart module (201) has instructed the controller (202) to electrically activate the hydraulic control unit (203) and hydraulically pressure up, via the hydraulic line 303, the actuation device 405. For example, the hydraulic pressure beans up the bottom plate 407 to compress the actuation device 405 and move the piston 403. With the actuation device 405 compressed, the tapered surface 410 forms a choke size of the self-automated adjustable choke valve 204 larger than the choke size in the first position to allow for fluid flow to the production flow line 115.

As shown in FIG. 4C, the self-automated adjustable choke valve 204 is illustrated in a third position. In the third position, the smart module (201) has instructed the controller (202) to electrically activate the hydraulic control unit (203) and further hydraulically pressure up, via the hydraulic line 303, the actuation device 405 than the hydraulic pressure in the second position. For example, the hydraulic pressure beans up the bottom plate 407 to further compress the actuation device 405 and move the piston 403. With the actuation device 405 fully compressed, the tapered surface 410 forms the largest choke size of the self-automated adjustable choke valve 204 to allow for fluid flow to the production flow line 115.

Figure 5:
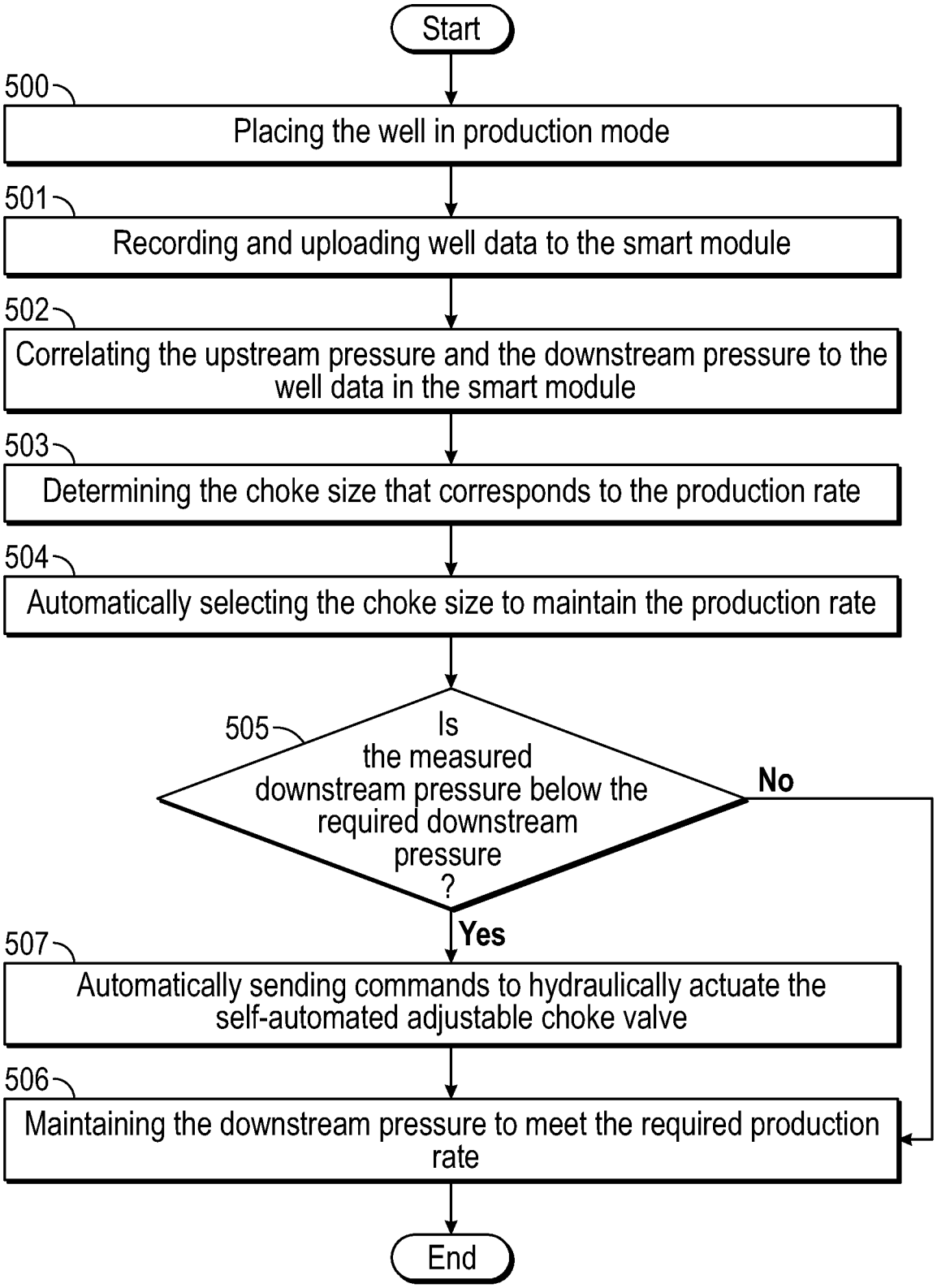
FIG. 5 illustrates a flowchart according to one or more embodiments of the present disclosure.

FIG. 5 is a flowchart showing a method of a fluid injection using the autonomous production system 200 of FIGS. 2-4C. One or more blocks in FIG. 5 may be performed by one or more components (e.g., the smart module 201 coupled to the controller 202 in communication with the self-automated adjustable choke valve 204) as described in FIGS. 2-4C. For example, a non-transitory computer readable medium may store instructions on a memory coupled to a processor such that the instructions include functionality for operating the self-automated adjustable choke valve 204. While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 500, the well is placed in production mode to produce fluids from the reservoir. For example, fluids, such as hydrocarbons, flow out of the reservoir and enter the well via perforations. In the well, the fluids flow upward through the production to reach the surface. At the surface, the fluids travel through the wellhead and to the Christmas tree. From the Christmas tree, the fluids flow out of the Christmas tree via the production outlet to flow into the self-automated adjustable choke valve and the into the production storage, transport, or facility via the production flow line.

In Block 501, well data is recorded and uploaded to the smart module. For example, the well data may include various data on the producing well such as the historical production performance data, the IPR and VLP curves with several sensitivities of choke sizes of the self-automated adjustable choke valve, and other supporting well data (historical choke performance, declining rate, etc.).

In Block 502, the smart module correlates the upstream pressure and the downstream pressure, relative to the self-automated adjustable choke valve, to the well data. For example, the sensors on the production outlet and the production flow line record in real-time the fluid pressure and transmits the measurements to the smart module to be correlated with associated flow rates in the IPR and VLP curves and other inputted parameters.

In Block 503, the smart module determines the choke size that corresponds to the required production rate of the well based on the well data. For example, the smart module cross-correlates the choke size with required production rate by systematically interpolate the upstream and downstream pressure to the IPR and VLP curves.

In Block 504, the smart module automatically adjusts the self-automated adjustable choke valve to the required choke size associated with the required production rate in real-time. For example, the controller of the smart module commands the hydraulic control unit to hydraulically actuate the self-automated adjustable choke valve to the choke size that maintains the required production rate. More specifically, the choke size is defined by positioning the tapered needle at the end of the piston in the outlet of the choke valve.

In Block 505, the smart module receives the downstream pressure measurement and determines if the measured downstream pressure is below the required downstream pressure to maintain the required production rate. If the measured downstream pressure is not below the required downstream pressure, the smart module maintains downstream pressure by not adjusting the choke size of the self-automated adjustable choke valve to meet the require production rate, as shown in Block 506. Additionally, the upstream and downstream pressure will continuously transmit the pressure measurements to the smart module for the life of the well such that the smart module may continuously adjust the choke size to maintain the require production rate based on the IPR and VLP curves.

However, if the measured downstream pressure is below the required downstream pressure, in Block 507, the controller of the smart module automatically commands the hydraulic control unit to hydraulically actuate the self-automated adjustable choke valve until the required downstream pressure is achieved so that the required production rate can be maintained. For example, the smart module may command the controller to electrically activate the motor of the hydraulic control unit to power the pump of the hydraulic control unit which hydraulically pressures up the self-automated adjustable choke valve to the choke size corresponding to the required downstream pressure.

In one or more embodiments, the flowchart of FIG. 5 allows for the controller, over the smart module, to maintain the downstream pressure such that the required production rate is met. With the stored well data and real-time upstream and downstream pressure measurements, the controller, over the smart module, commands the hydraulic control unit to hydraulically actuate the self-automated adjustable choke valve. For example, the hydraulic control unit is used to change the choke size of the self-automated adjustable choke valve to maintain the required downstream pressure at the required production rate. The generated commands from the smart module allow the controller to maintain the required downstream pressure corresponding to the required production rate by adjusting the choke size of the choke valve to match the required choke size. One skilled in the art will appreciate how utilizing the controller coupled to the smart module, the autonomous production system discloses herein allow for fast and simple choke adjustments to maintain the required production rate and improve the productivity of the well. Extending values of an automatic self-automated and adjusted choke valve in maintaining production deliverability is one of the most effective mitigation solutions for aging wells located in matured field and experience having high rate fluctuation, particularly, for an area that has huge number of wells that scattered in remote location where they are not equipped with real time pressure monitoring system and less operator's attendance. Embodiments disclosed herein minimize manual choke adjustment that requires frequent human intervention by introducing automatic system to self-adjusted choke valve. As a result, embodiments disclosed herein reduce the incompliant wells that are not complying with a predefined production target.

Figure 6:
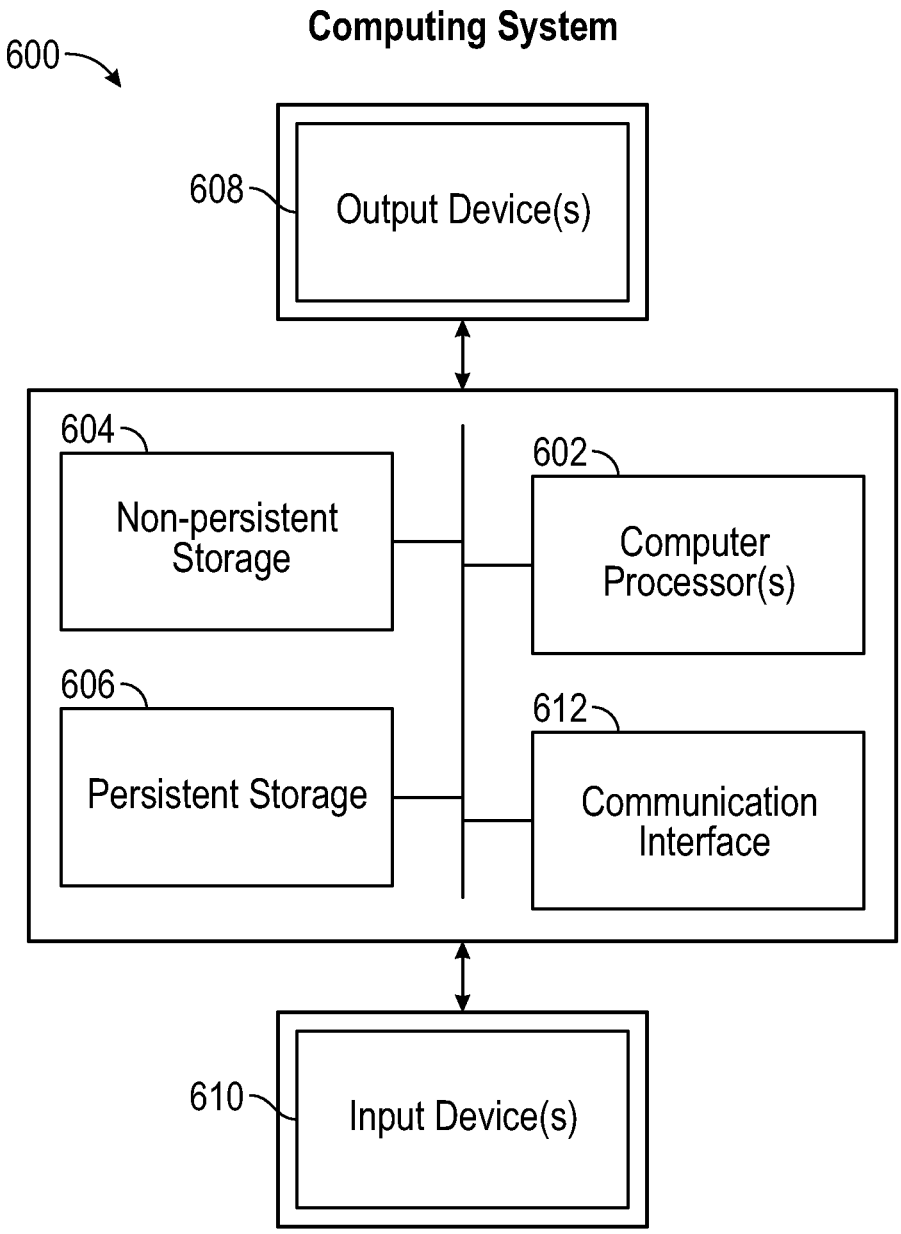
FIG. 6 illustrates a computing device according to one or more embodiments of the present disclosure.

Implementations herein for operating the autonomous production system 200 may be implemented on a computing system (e.g., smart module 201) coupled to a controller (202) in communication with the various components of the self-automated adjustable choke valve 204. Any combination of mobile, desktop, server, router, switch, embedded device, or other types of hardware may be used with the self-automated adjustable choke valve 204. For example, as shown in FIG. 6, the computing system 600 may include one or more computer processors 602, non-persistent storage 604 (e.g., volatile memory, such as random access memory (RAM), cache memory), persistent storage 606 (e.g., a hard disk, an optical drive such as a compact disk (CD) drive or digital versatile disk (DVD) drive, a flash memory, etc.), a communication interface 612 (e.g., Bluetooth interface, infrared interface, network interface, optical interface, etc.), and numerous other elements and functionalities. It is further envisioned that software instructions in a form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. For example, the software instructions may correspond to computer readable program code that, when executed by a processor(s), is configured to perform one or more embodiments of the disclosure.

The computing system 600 may also include one or more input devices 610, such as a touchscreen, keyboard, mouse, microphone, touchpad, electronic pen, or any other type of input device. Additionally, the computing system 600 may include one or more output devices 608, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) 602, non-persistent storage 604, and persistent storage 606. Many different types of computing systems exist, and the input and output device(s) may take other forms.

The computing system 600 of FIG. 6 may include functionality to present raw and/or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model. For example, a GUI may first obtain a notification from a software application requesting that a particular data object be presented within the GUI. Next, the GUI may determine a data object type associated with the data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the data object and render a visual representation of the data values within a display device according to the designated rules for that data object type.

Data may also be presented through various audio methods. Data may be rendered into an audio format and presented as sound through one or more speakers operably connected to a computing device. Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

In addition to the benefits described above, the self-automated adjustable choke valve with the autonomous production system may improve an overall efficiency and performance at the well while reducing cost, well site safety, reduced risk of non-productive time (NPT), and many other advantages. Further, the self-automated adjustable choke valve with the autonomous production system may provide further advantages such as removing well performance fluctuations, reducing the need for frequent well testing, and reducing or eliminating human interaction with well equipment to reduce human errors. It is noted that the self-automated adjustable choke valve with the autonomous production system may be used for onshore and offshore oil and gas operations.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system, comprising:

a choke valve coupled to a Christmas tree on a wellhead;

a smart module coupled to the choke valve;

a hydraulic control unit coupled to the smart module and the choke valve, wherein the hydraulic control unit hydraulically actuates the choke valve;

a first sensor attached upstream of the choke valve and a second sensor attached downstream of the choke valve, wherein the first sensor measures an upstream pressure and the second sensor measures a downstream pressure; and a controller coupled to the smart module and the hydraulic control unit, wherein the smart module receives the upstream pressure, the downstream pressure, and well data to generate commands to adjust a choke size of the choke valve corresponding with a required production rate of a well, wherein the well data is a historical production performance data on the well to create Inflow Performance Relationship and Vertical Lift Performance Relationship curves; and wherein the controller manages a transmission of hydraulic pressure from the hydraulic control unit to actuate the choke valve based on the generated commands.

2. The system of claim 1, wherein the smart module is configured to systematically interpolate the upstream and downstream pressure to the Inflow Performance Relationship and Vertical Lift Performance Relationship curves to determine the choke size that corresponds to the required production rate.

3. The system of claim 1, wherein the first sensor is attached to a production outlet between the Christmas tree and the choke valve and the second sensor is attached to a production flow line between the choke valve and a production storage, transport, or facility.

4. The system of claim 1, wherein when actuated, the hydraulic pressure compresses a spring of the choke valve to bean up a piston of the choke valve.

5. The system of claim 4, wherein a tapered surface of a needle at an end of the piston is the choke size of the choke valve.

6. The system of claim 4, wherein the controller electrically activates a motor of the hydraulic control unit to power a pump the hydraulic control unit which provides the hydraulic pressure to the choke valve.

7. A method, comprising:

placing a well in a production mode to produce fluids from a reservoir;

uploading a historical production performance data of the well to a smart module to create Inflow Performance Relationship and Vertical Lift Performance Relationship curves;

correlating, with the smart module, an upstream pressure and a downstream pressure relative to a choke valve with production flow rates in the Inflow Performance Relationship and Vertical Lift Performance Relationship curves;

determining, with the smart module, a choke size that corresponds to a required production rate of the well based systematically interpolating the upstream pressure and the downstream pressure to the Inflow Performance Relationship and Vertical Lift Performance Relationship curves;

automatically adjusting, with a controller coupled to the smart module, the choke valve to a required choke size associated with the required production rate in real-time, wherein the automatically adjusting comprises generating commands, with the smart module, for the controller to manage a transmission of hydraulic pressure from a hydraulic control unit to actuate the choke valve; and maintaining a required downstream pressure corresponding to the required production rate by the smart module generating the commands from the controller to adjust a choke size of the choke valve to match the required choke size.

8. The method of claim 7, further comprising, if a measured downstream pressure is not below the required downstream pressure, maintaining the choke size to meet the required downstream pressure corresponding to the required production rate.

9. The method of claim 7, further comprising, if a measured downstream pressure is below the required downstream pressure, automatically generating commands from the smart module for the controller to hydraulically pressure up, with the hydraulic control unit, the choke valve to a choke size corresponding to the required downstream pressure.

10. The method of the claim 9, further comprising electrically activating, with the controller, a motor of the hydraulic control unit to power a pump of the hydraulic control unit to compress a spring of the choke valve and bean up a piston thereby adjusting the choke size.

11. The method of claim 10, further comprising: positioning a tapered needle at an end of the piston in an outlet of the choke valve to define the choke size.

12. The method of claim 7, further comprising: continuously transmitting downstream pressure measurements to the smart module for a life of the well.

13. The method of claim 12, further comprising: continuously adjusting, with the smart module, the choke size to maintain the required production rate based on the Inflow Performance Relationship and Vertical Lift Performance Relationship curves.

14. The method of claim 7, further comprising: transmitting the upstream pressure and the downstream pressure to the smart module with a first sensor positioned upstream the choke valve and a second sensor positioned downstream the choke valve.

15. A non-transitory computer readable medium storing instructions on a memory coupled to a processor, the instructions comprising functionality for:

obtaining a historical production performance data of a well to create Inflow Performance Relationship and Vertical Lift Performance Relationship curves for the well;

determining a choke size of a choke valve that corresponds to a required production rate of the well based on systematically interpolating an upstream pressure and a downstream pressure to the Inflow Performance Relationship and Vertical Lift Performance Relationship curves, wherein the upstream pressure is a fluid pressure upstream the choke valve and the downstream pressure is a fluid pressure downstream the choke valve;

automatically adjusting, over a smart module coupled to the choke valve, the choke size to match a required choke size associated with the required production rate in real-time;

transmitting, based on commands generated from the smart module, hydraulic pressure from a hydraulic control unit to actuate the choke valve; and maintaining a required downstream pressure corresponding to the required production rate by adjusting the choke size based on a measured downstream pressure.

16. The non-transitory computer readable medium of claim 15, wherein if the measured downstream pressure is not below the required downstream pressure, the instructions further comprise functionality for:

maintaining the choke size to meet the required downstream pressure corresponding to the required production rate, wherein the measured downstream pressure is determined using sensor data.

17. The non-transitory computer readable medium of claim 15, wherein if the measured downstream pressure is below the required downstream pressure, the instructions further comprise functionality for:

automatically generating commands to hydraulically pressure up the choke valve to a choke size corresponding to the required downstream pressure;

wherein the hydraulic control unit provides the hydraulic pressure to the choke valve.

18. The non-transitory computer readable medium of claim 17, wherein the instructions further comprise functionality for:

electrically activating a motor of the hydraulic control unit to power a pump of the hydraulic control unit to compress a spring of the choke valve and bean up a piston thereby adjusting the choke size.

19. The non-transitory computer readable medium of claim 15, wherein the instructions further comprise functionality for:

obtaining the upstream pressure and the downstream pressure with a first sensor positioned upstream the choke valve and a second sensor positioned downstream the choke valve.

* * * * *